United States Patent [19]

Golikov et al.

[11] 3,947,344

[45] Mar. 30, 1976

[54] INERT ANODE

[76] Inventors: Nikolai Sergeevich Golikov, ulitsa Sovetskoi Armii, 33, kv. 59; Boris Iosifovich Berlin, prospekt Lenina 52/1, kv. 73; Boris Evgenievich Popov, ulitsa Sovetskaya 137, kv. 30; Andrei Dmitrievich Filatov, ulitsa Kuibysheva 21, kv. 29; Dmitry Prokhorovich Galkin, prospekt Lenina 69, kv. 8, all of Magnitogorsk Chelyabinskoi oblatsi, U.S.S.R.

[22] Filed: Mar. 28, 1974

[21] Appl. No.: 455,958

Related U.S. Application Data

[63] Continuation of Ser. No. 355,295, April 27, 1973, abandoned.

[52] U.S. Cl. ..... 204/286; 204/280; 204/288

[51] Int. Cl.[2] ..... C25D 17/12; C25D 17/10

[58] Field of Search ..... 204/290 F, 293, 280, 286, 204/288

[56] References Cited

UNITED STATES PATENTS

| | | | |
|---|---|---|---|
| 1,311,096 | 7/1919 | Smith | 204/293 X |
| 1,441,567 | 1/1923 | Fink | 204/293 X |
| 1,448,208 | 5/1923 | Gerstle | 204/288 X |
| 1,807,585 | 6/1931 | Becker | 204/293 |
| 2,851,413 | 9/1958 | Hosford | 204/196 |

FOREIGN PATENTS OR APPLICATIONS

| | | | |
|---|---|---|---|
| 157,871 | 8/1921 | United Kingdom | 204/293 |

*Primary Examiner*—F. C. Edmundson
*Attorney, Agent, or Firm*—Holman & Stern

[57] ABSTRACT

An anode made essentially as a plate of a ferrosilicon alloy having a wire-made structural base, the wire being fastened on a metallic bar which also carries also a current lead-in. Such a composite construction for an anode enables an electrotinning process to occur without periodical reclaiming of the tin-enriched electrolyte.

3 Claims, 2 Drawing Figures

INERT ANODE

Figures 1, 2:
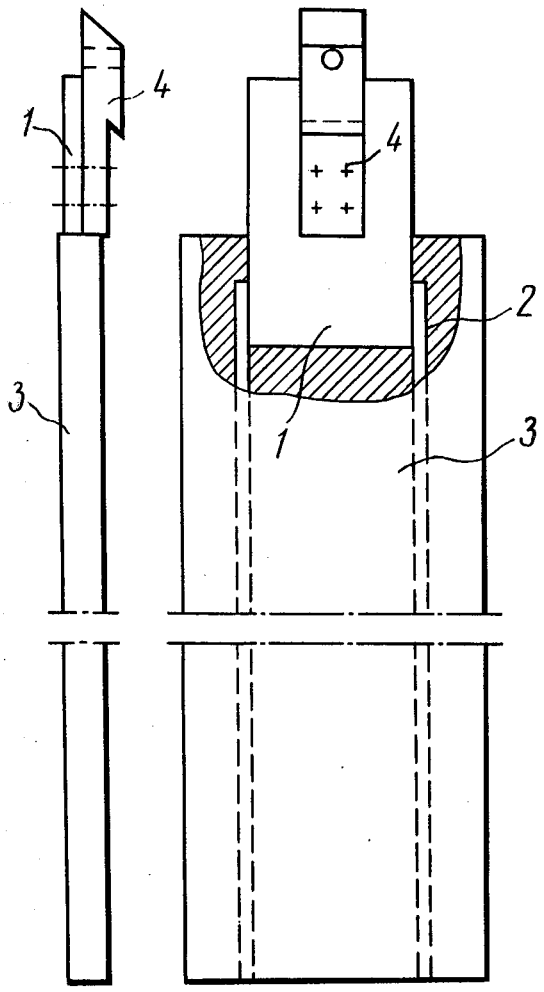

This is a continuation of application Ser. No. 355,295, filed Apr. 27, 1973, now abandoned.

The present invention relates generally to electroplating practice.

More specifically, the invention is concerned with equipment used in electrolytic deposition of metals upon the surface of specified objects, and has particular reference to inert anodes used in tin plating processes of sheet metal.

At present inert anodes are applicable for use in stationary baths with an acid tin-plating electrolyte.

The known inert anodes consist of a base plate with a current lead-in fixed thereon. The base plate is made of a homogeneous material such as steel, titanium, platinum, ferrosilicon alloy, and other materials.

However, the known inert anodes suffer from the disadvantage that they are too expensive (in case of a platinum or the titanium inert anode), or partially soluble (for a steel inert anode) which results in the pollution of the electrolyte with alien impurities, such as iron salts, which adversely affects the quality of the coating being deposited.

An inert anode made of an iron-silicon alloy alone, is structurally brittle and friable, and therefore fails to find application in industrial practice for tin plating sheet metal, despite the fact that said material is less soluble in the electrolyte than any other.

Besides, when the tin plating process for sheet metal takes place in an acid electrolytes, say, in a bisulphate tinning bath or an acid phenol-sulphonic tinning bath, the yield of tin vs the anode current (the anode efficiency) is from 4–5 percent higher than that of the cathode current.

Such a prevalence of the anode efficiency over the cathode tin content in the electrolyte tends to be an evergrowing one which adversely affects the quality of the deposited coating, i.e. the latter becomes uneven.

In order to keep the predetermined tin concentration in the tinning bath, part of the electrolyte is let out of the bath and directed toward tin reclaiming.

All of the afore-discussed results in a process for electrolytic tin deposition which is more sophisticated and which involves extra equipment for its realization.

As is known from world-wide practice that the excess tin from a tinning bath can be extracted either as a metallic tin with the use of inert anodes in stationary baths, or by virtue of chemical deposition followed by the reclaiming of tin from the slime. The former method is more economical, however, it is hardly practicable under production conditions due to two kinds of origin, viz, either the anodes (lead, steel, stainless steel etc.) are perceptibly dissolved and thus pollute the electrolyte with harmful impurities, or a vigorous acid oxidation process occurs on the anodes (platinum, of carbon-containing materials, etc.).

In both cases the electrolyte is rendered unfit for further use and is therefore wasted.

Moreover, in both of the aforesaid cases part of the electrolyte has to be withdrawn from the tinning process, as tin deposition occurs at low parameters and involves high losses of such a scarce material as the tin, as well as the use of complicated equipment.

It is an object of the present invention to provide such an anode the use of which would enable a good-quality coating to be obtained in electrotinning processes.

It is another object of the present invention to provide such an anode the use of which would substantially simplify the electrotinning process techniques.

Said objects are accomplished by the fact that an inert anode is used in the electrotinning process incorporating a base plate carrying a current lead-in, said base plate, according to the invention, having a metal bar bearing a metal wire which serves as a structural base for said plate said plate being made of a ferrosilicon alloy which is fixed on said metal bar.

Due to the use of the herein-proposed anode for such processes as the electrotinning process wherein part of the tin-enriched electrolyte of the tinning bath can be withdrawn and part of the complicated auxiliary equipment can be done away with; besides, in the electrotinning process using the proposed inert anode, the possibility of minimizing tin losses, as well as the losses of all the other components of a tinning electrolyte, viz., acids and surface-active additives, this being attained due to the electrotinning process proceeding concurrently with the electrolyte reclaiming process; thus, the electrotinning process gets stabilized, as the tin concentration is constantly being maintained within the technologically specified limits.

Further objects and advantages of the present invention will become more apparent from the following detailed disclosure of its exemplary embodiments given by way of illustration with reference to the accompanying drawings, wherein:

FIG. 1 is a longitudinal-section view of an inert anode, according to the invention; and FIG. 2 is a side elevation of the anode of FIG. 1.

Now referring to the drawings, the inert anode of the invention consists of a metallic bar 1 which may be made of copper, stainless steel, cobalt, or nickel; however, as a preferred and specific material, we propose stainless steel for manufacturing the metallic bar 1 therefrom, since it possesses a relatively higher mechanical strength and is inexpensive.

A metal wire 2 is secured to the surface of the bar 1 by means of, for instance, electric-arc welding, with said wire being made of the same material as the bar 1.

The metal wire 2 serves as the structural base for a plate 3 which is preferably made of a ferrosilicon alloy, as has been suggested we have pointed out hereinabove, with said material being less soluble in the electrolyte used and thus does not pollute the latter.

When making the anode plate 3 according to the present invention, a ferrosilicon alloy of the following composition was used:

Si — 10–20 wt.%;

Fe — 88–78 wt.%;

other impurities (Mn, C, Al, P, S, etc.) — 2 wt.% maximum.

The brittleness and friability of the ferrosilicon alloy necessitates the use of the reinforcing wire 2 which thus imparts more strength and rigidity to the plate 3.

The current-conducting part of the inert anode, viz., a current lead-in 4 is made fast on the bar 1 at the end opposite to that carrying the plate 3 which has the reinforcing metal wire 2. The current lead-in may be made of any metal or alloy that precludes current losses. The current lead-in should be expediently made of tin since it is considered to be the best contact for the inert anode of the invention with the anode busbar (not shown).

Given below is a description of the electrotinning process involving the use of the inert anode proposed by the present invention.

Electrotinning occurs in an acid electrolyte having the following composition:

tin — 25–40 g/1;
phenolsulphonic acid — 50–60 g/l;
dihydroxydiphenyl-sulphone — 6–12 g/l;
ariscap — 0.4–1.0 g/l;

and at an electrolyte temperature of 35°C. The electrolyte circulates between the heat exchanger and the bath. A metal strip, viz., a cathode serves as an object to be treated.

Tin plates are used as the anode. Current is fed to the anodes through the anode bars from which they are suspended. The anode bars rise above the electrolyte level by some 150–200 mm a.

The electrotinning process occurs at a cathode current density of 15–20 A/dm$^2$.

Once the tin concentration in the electrolyte has exceeded the permissible level, tin anodes are eliminated from one of the tinning baths (as viewed in the direction of the strip movement), while in the rest of the baths the tin anodes are left; and instead of being removed, the tin anodes are suspended from the anode bars according to the proposed in the present invention, in such a way that the plate 3 of the ferrosilicon alloy, i.e., the insoluble part of the anode, is immersed in the electrolyte, whereas the current-conducting part, i.e., the current lead-in 4 and the metallic bar 1 are arranged over the electrolyte level.

The inert anodes having been suspended, the current starts to be fed thereto, and the tin reclaiming process occurs according to the following reaction:

$$Sn^{+2} + 2e^- \rightarrow Sn^0$$

(from electrolyte)

As a result, tin is deposited directly upon the strip, i.e., the process of tin reclaiming occurs concurrently with the tinning process. At the same time the process of oxygen liberation occurs on the insoluble part of the anode, i.e., the plate 3. It is due to both of the said processes that the electrolyte gets depleted of tin.

Upon reaching the tin content specified by the process techniques, the inert anodes are removed from the bath and replaced by tin anodes. This procedure is repeated periodically which enables the tin concentration to be maintained within the preset limits and for a good-quality deposition coating to be obtained.

It should be noted that the proposed inert anode can also find widespread application in the electrodeposition of zinc, chromium, copper and other metals.

What is claimed is:

1. An electrometallurgical inert anode assembly for electrometallurgical plating baths, comprising a ferro-silicon alloy plate comprising from 10 to 20% by wt. of silicon, and from 78 to 88% by wt. of iron; a metallic bar fashioned from a metal selected from the group consisting of copper, stainless steel, cobalt, and nickel, said bar being rigidly secured in the body of said plate at one end thereof and having a current means input connected thereon; metallic wires having the same composition as said bar fastened at one end thereof to said bar, and arranged along the length of said bar, and along the length of the ferro-silicon plate to the end of said plate, said wires being rigidly connected so as to serve as the structural base therefor.

2. The anode as claimed in claim 1, wherein the electrometallurgical plating baths are selected from the group consisting essentially of electrotinning baths, electrozinc baths, electrochromium baths, and electrocopper baths.

3. The anode as claimed in claim 2, wherein the electrometallurgical plating bath is an electrotinning bath.

* * * * *